US005682754A

United States Patent [19]

Groenewold

[11] Patent Number: 5,682,754

[45] Date of Patent: Nov. 4, 1997

[54] METHOD AND APPARATUS FOR CONTROLLING SWIMMING POOL ROOM AIR AND WATER TEMPERATURES

[75] Inventor: Peter E. Groenewold, Wauwatosa, Wis.

[73] Assignee: Desert Aire Corp., Milwaukee, Wis.

[21] Appl. No.: 677,326

[22] Filed: Jul. 2, 1996

[51] Int. Cl.[6] ..... F24F 7/06

[52] U.S. Cl. ..... 62/179; 454/238; 236/49.3

[58] Field of Search ..... 62/179, 180, 186, 62/173; 454/70, 256, 258, 340, 229, 238, 239; 236/49.3, 44 R, 44 C

[56] References Cited

U.S. PATENT DOCUMENTS

| | | | |
|---|---|---|---|
| 4,086,781 | 5/1978 | Brody et al. | 62/180 |
| 4,210,278 | 7/1980 | Obler | 236/49.3 |
| 4,407,185 | 10/1983 | Haines et al. | 454/238 |
| 5,257,958 | 11/1993 | Jagers | 454/238 |

*Primary Examiner*—Harry B. Tanner
*Attorney, Agent, or Firm*—Ryan, Maki, Mann & Hohenfeldt

[57] ABSTRACT

A swimming pool room air conditioner has a duct with an inlet return for air drawn from the pool room and a supply air blower downstream from the inlet of the duct for the blower to draw air through the duct and supply it to the pool room after the air is conditioned. The duct inlet, an evaporator coil for cooling and dehumidifying return air, an air reheat condenser coil and the supply blower are arranged in the duct in the stated order. A motor controlled damper is arranged for bypassing return air around the evaporator coil and thereby cause a predetermined humid return air flow over the evaporator. An exhaust blower is provided. A motor controlled warm air damper is arranged for allowing the exhaust blower to draw a fraction of the return air before the return air flows over the dehumidifier evaporator coil and discharges the fraction to outdoors. A cool air damper is arranged for the exhaust blower to exhaust a fraction of the cooled air to the outdoors. An air makeup damper allows drawing in a volume of outdoor fresh air. All dampers are controlled to establish predetermined constant air flows by sensing the static pressure differences across the exhaust blower, the evaporator, and the reheat condenser coil and comparing the signals representing the determined predetermined air flows with set points with a programmable controller that issues signals that cause the damper motors to regulate until variances between difference signals and set points are nulled.

6 Claims, 1 Drawing Sheet

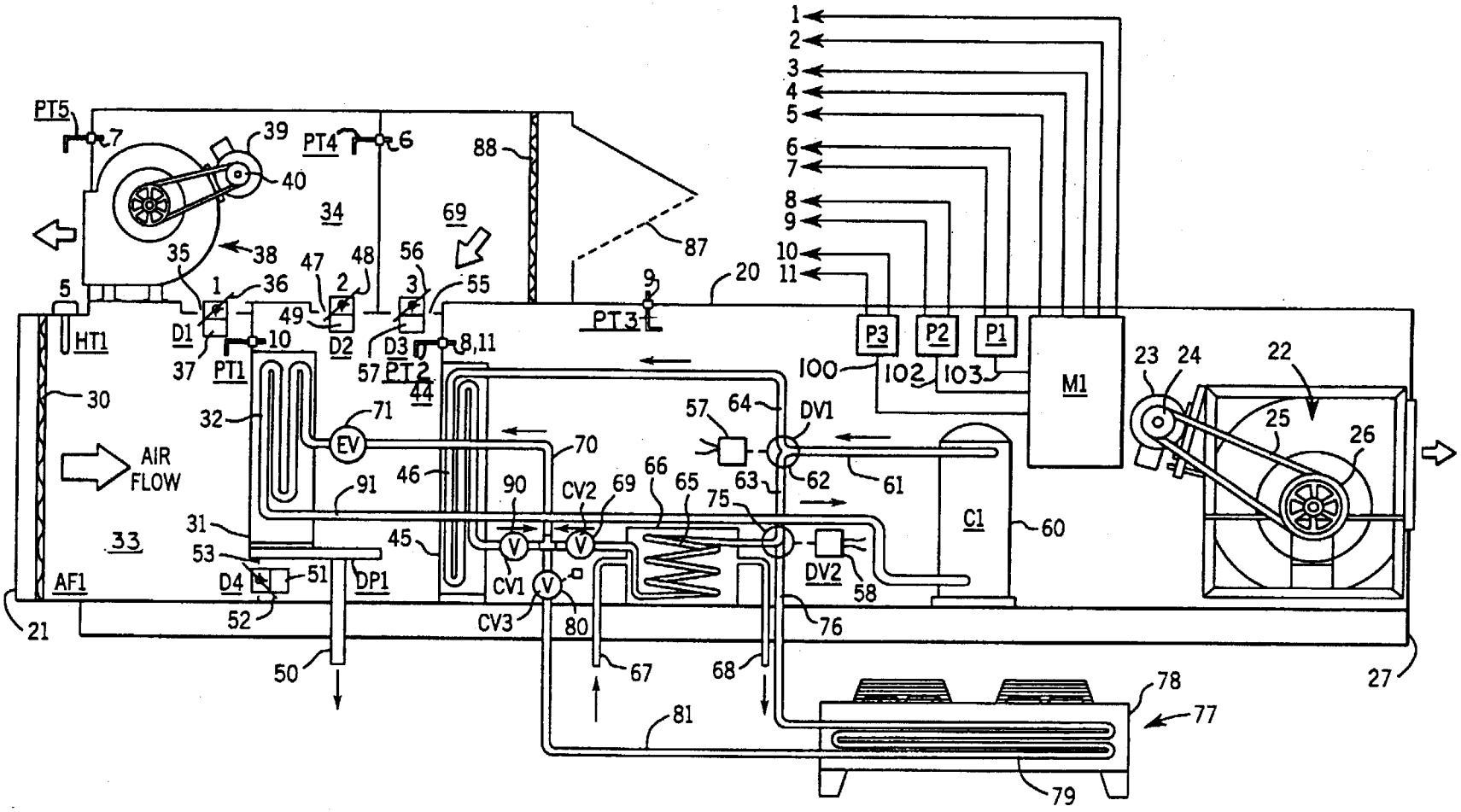
M1
P1
P2
P3
C1
DV1
DV2
CV1
CV2
CV3
EV
D1
D2
D3
D4
DP1
PT1
PT2
PT3
PT4
PT5
HT1
AF1
AIR FLOW

METHOD AND APPARATUS FOR CONTROLLING SWIMMING POOL ROOM AIR AND WATER TEMPERATURES

BACKGROUND OF THE INVENTION

The invention disclosed herein pertains to a method and apparatus for controlling a unit that is operative to dehumidify, heat, cool and refresh the air in a room that contains a swimming pool.

The humidity of the air in a swimming pool room is usually excessive and is harmful to the building and detrimental to the comfort of the occupants of the room. The high humidity results from evaporation of water from the surface of the pool. As is well known, evaporation results in a loss of heat energy from the pool and that energy inheres as sensible and latent heat in the vapor. Air conditioning units have been used for dehumidifying the return air from a swimming pool room by passing the air over the evaporator coil of a refrigeration system which drops the temperature of the air below the dew point, thereby precipitating at least a major part of the water out of the air after which the air is resupplied to the pool room. When the system is operating in the pool room air heating mode, the heat that is absorbed by the refrigerant in the evaporator coil in the dehumidifying process is used to reheat the dehumidified air by conducting the refrigerant through a reheat condenser coil and passing the dehumidified air over the coil. When the unit is operating in the air cooling mode, the heat absorbed in the refrigerant in the dehumidifying evaporator is recovered and not used to heat the pool room air but may be used to add heat to the pool water to make up for some of the heat lost by evaporation or the recovered heat is simply dissipated to the atmosphere. Advanced dehumidifying refrigeration systems are, of course, controlled so they switch between heating and cooling modes of operation automatically depending on the temperature of the air in the pool room.

Building codes require that some outdoor fresh makeup air be added to the dehumidified return airstream before it is supplied to the pool room again and codes also require that a specified number of air changes be made per hour in the room. This requires that a certain number of cubic feet of return air be drawn from the pool air per minute which depends on the size of the room. The fresh outdoor air that must be introduced into the airstream in the conditioning unit may be extremely warm and humid in warm weather and extremely cold and dry in cold weather so a very versatile system control that can cope with highly variable conditions would be desirable. In cold weather it is important to recover as much as possible of the latent and sensible heat contained in the return air that is evaporated from the pool so this heat can be restored to the pool water to make up for heat lost by evaporation. In the warm weather it would be desirable to exhaust to the atmosphere as much of the sensible and latent heat containing return air as is permissible since this is the warmest air in the system and helps to assure that the cooling capacity of the evaporator coil is not exceeded. As a result of exhausting some of the warm and humid return air it becomes possible to add outdoor air to the airstream in the unit to make up for return air that has been exhausted to thereby balance the return air that is withdrawn from the room with the air that is resupplied to the pool room.

Because indoor and outdoor air temperatures and humidity vary over large ranges through the seasons it will be evident that a highly versatile control system would be necessary to keep the system balanced to maintain the proper air exchange frequency and the proper supply air temperature and humidity for maximum comfort of the occupants of the pool room and at the highest coefficient of performance or energy utilization efficiency that is possible.

Good energy conservation performance of a pool air and water conditioning system can only be obtained if the system can be easily and accurately balanced concurrently with completion of the installation of the system and if that balance is automatically maintained without attention during subsequent operation of the system. It is the usual practice to provide the system installation contractor with a manual containing instructions for balancing the system upon completion of the installation. However, experience has shown that the difficulty of obtaining proper balance with pre-existing system controllers and the patience it took to get a good result has resulted in systems going into use without ever having been properly balanced. One contribution to resolving the problem of balancing the input and output air in the unit and maintaining balance during long periods of operation resides in providing a control system that makes it easy, even for one who is unskilled in doing this kind of work, to balance the conditioning system quickly and optimally.

SUMMARY OF THE INVENTION

The new air conditioner balance control equipment disclosed herein is illustrated in connection with a pool room air and water conditioning system that is distinguished (1) by exhausting to the outside atmosphere, when the system is in the room air cooling mode, a significant fraction of the hottest or highest energy return air before the remainder of the return air is passed through the evaporator cooling coil for heat removal, and (2) by exhausting to the atmosphere, when the system is in the room air heating mode, a significant fraction of the coldest or lowest energy return air after its heat is extracted by an evaporator cooling coil so an ensuing reheating condenser coil over which the remainder of the return air and makeup air mixture passes will be able to reheat the air with heat derived from refrigerant that has been heated in a heat pump mode when the return air was passing over the evaporator cooling coil.

The new control system is illustrated in conjunction with a swimming pool room air dehumidification, heating and cooling system comprised of a large main duct having an inlet for return air from a room containing a swimming pool and having an outlet for supplying conditioned air to the pool room. The evaporator coil of a refrigeration system is arranged near the inlet of the duct for return air to pass over it. After the air is dehumidified by the evaporator it is passed over an air reheat condenser coil which is functioning when the system is operating in the air dehumidifying and heating mode. The airstream is then drawn to the inlet of a supply blower which is situated at the opposite end from the inlet of the main duct. From the outlet of the supply blower, the conditioned air is supplied through a duct to the pool room.

A plenum above the main duct has an exhaust blower whose inlet can communicate with the space in the main duct preceding the return air inlet side of the evaporator coil through a controllable motor driven "warm air" exhaust damper. The fraction of the warm and humid return air that is exhausted when the system is operating in the return air cooling mode is fixed as a set point in a programmable controller used in the new control system. According to the invention, when the pool room air is being cooled the correct amount of warm and humid air to be exhausted is determined by measuring the static air pressure at the inlet and outlet of an exhaust fan and comparing the difference between the two pressures with a set point. The two pressures are sent to a transducer which determines their difference, converts the difference to an electric signal and sends it a programmable controller which compares it with the set point. If there is a discrepancy between the difference between the measured static pressure and the set point, the difference is represented as an error signal by the controller which converts difference to an error signal and uses the signal to control the warm air damper to change its position until the error is nulled. The fraction of return air that is exhausted is thereby held constant in any given system.

A second motor driven damper, called the "cool air" damper, is installed between the outlet side of the dehumidifier evaporator coil and the exhaust plenum to which the inlet of the exhaust blower is presented. The cool air damper is used to regulate the fraction of the coldest air in the system which is to be exhausted when the system is operating in the heating mode at which time the warm air exhaust damper D1 is closed. Some of the coldest air is exhausted to avoid reheating it and to make room in the airstream in the main duct for addition of outdoor makeup air which must be done to comply with the building codes. The fraction of cool air that is set to be exhausted is determined by using pitot tubes to sense the static pressure at the inlet and the outlet of the exhaust blower. The static pressures are conducted by tubing to a transducer in which the difference in pressures is converted to a corresponding electric signal which is compared by the programmable controller to a set point. If there is a discrepancy with the set point, an error signal is generated by the controller and transmitted to the motor of the second damper D2 to adjust it so the signal is nulled. Thus, the set amount of the coolest air in the system is constantly being exhausted when the system is operating in the heating mode.

A third motor controlled damper D3 is installed between an outdoor air infeed plenum and the space bounded by the outlet side of the evaporator and the inlet side of the reheater condenser coil. The static pressures at the inlet side and outlet side of the reheat condenser coil are sensed using pitot tubes positioned at those sides. The difference between the two pressures is determined by a transducer and the resulting corresponding electric signal representing the difference is compared with a set point by the programmable and any resulting error signal is used to adjust the third or outdoor air makeup damper until the error signal is nulled and the correct quantity of outdoor air mixes with the airstream for the total air that is conducted in the main duct to the inlet of the supply blower equals the set point for the total air that must be supplied to the pool room to meet the number of air changes per hour required by the building code. Of course, the makeup air or third damper is used in the heating and cooling modes of system operation since it is necessary to replace the cold and warm air quantities that are exhausted in both cases.

How the foregoing and other objectives and features of the new control system for a pool room air and water conditioning system are achieved and implemented will appear in the more detailed description of a preferred embodiment of the new control system which will now be set forth in reference to the accompanying drawing.

DESCRIPTION OF THE DRAWING

The single drawing figure is a diagram of a swimming pool air and water conditioning system in which the new control system is installed.

DESCRIPTION OF A PREFERRED EMBODIMENT

In the drawing, the main duct or housing through which a mixture of the return air from the swimming pool room and outdoor makeup air is conducted for being supplied to the pool room is designated generally by the numeral 20. The inlet for air returned from the pool room at the left of the drawing is marked 21. The duct running from the inlet to the pool room is not shown. Flow of air through main system duct 20 is induced by a "supply air blower" 22 at the far right of the drawing. This blower supplies dehumidified and heated or cooled air including supplemental outdoor air to the swimming pool room through a duct which is not shown. The system is balanced, according to the invention, so the volume of return air drawn from the pool room is substantially equal to the volume of conditioned air fed to the pool room by the supply blower 22. Supply air blower 22 is driven with a single speed motor 23 on whose shaft there is a pulley 24. Motor 23 drives the pulley 26 on the blower shaft by means of a belt 25. In this illustrative system, motor pulley 24 is adapted for adjustment of its radius to obtain a rotational speed of the blower fan, not visible, that will result in moving a sufficient volume of air to assure that the number of total air changes per hour that is prescribed by the building code or is otherwise desired is achieved. The motor runs at constant speed which is possible because adjustment of the pulley 24 radius can be relied upon to yield a constant total air supply air flow.

After the return air passes through input filter 30 of main duct 20 it enters a space 33 which is at the inlet side of an open ended housing 31 containing a refrigerant evaporator or air cooling and dehumidifying coil 32. A plenum chamber 34 is defined by suitable walls above space 33. There is a "warm air" exhaust damper D1 comprised of motor 37 which, when an appropriate signal is received, drives a damper blade 36 to open or close warm exhaust port 35 as required. The warm air damper D1 is opened during operation of the system in the cooling mode to exhaust a fraction of the warmest and most humid return air from the pool room to the atmosphere. Exhaust blower 38 exhausts the air. It is driven by a motor 39 and is positioned in exhaust plenum 34. When the system is operating in the return air cooling and dehumidifying mode as is the case when the pool room temperature rises above the desired set temperature, about 15% to 30% of the warm and humid return air is exhausted to the atmosphere before the remainder of the return air is cooled and dehumidified by passing it over an evaporator cooling coil 32 of a refrigeration system. Damper port 35 is open when the conditioning system is functioning in the cooling mode. The advantage of this is that the fraction of the return air that is exhausted to the atmosphere outside of the building has the highest humidity and the highest latent and sensible heat content of any air in the system. One purpose of exhausting some of the warmest air is to allow for the addition of fresh outdoor makeup air to the airstream to establish the correct total amount of air that must be supplied to the pool room to maintain the required number of air changes per hour and keep the supply air output from the supply blower in constant balance with the inlet return air volume. Exhausting some of the return air reduces the amount of return air that will flow over the cooling evaporator coil 32 but exhausting is not relied upon for controlling air flow through the evaporator as will be explained. Control of flow through the evaporation is achieved by modulating a damper D4 which is described shortly hereafter.

If all of the return air were drawn over the cooling coil 32 when the air has high moisture content and high sensible and latent heat, it is unlikely that the vaporized refrigerant in the cooling coil 32 would be able to absorb all of the latent and sensible heat in the total quantity of the return air and still cool the air to below its dew point for and dehumidifying it. Indoor pool room attendants usually like to maintain the air at about 82° F. and 50% relative humidity which can be considered typical. On this basis the conditioning system designer is able to determine the optimum air volume through the evaporator 32 which will allow it to remove the most moisture. Hence, bypass damper D4 volume is controlled independently of exhaust air volume. Too much airflow can overload the evaporator 32 so as to raise its temperature, thereby reducing its moisture removal and condensing capacity. Excessive airflow can also result in condensate being blown off the evaporator coil surface and landing where it can cause corrosion. Insufficient airflow may result in condensate freezing so as to cause dehumidification to cease. This may require a service call. Low air flow can also prevent the refrigerant in the evaporator from boiling and vaporizing completely. If liquid refrigerant floods back to compressor 60 the liquid can damage or destroy it. Condensate that drips from the evaporator coil is caught in pan DP1 and returned to the pool via pipe 51.

To keep the volume of air flowing over evaporator coil 32 at the proper level a bypass damper D4 is used. This is not in itself new. However, the manner in which damper D4 is controlled herein is new. According to the invention, pitot tubes PT1 and PT8, 11, respectively, sense the static pressures on the input and output sides of condenser coil 32. Tubes 10 and 11 conduct the sensed pressures to transducer P3 which converts the difference between the pressures to, a corresponding electric signal which is transmitted by way of line 100 to controller M1. Controller M1 compares the signal with a set point signal. If there is no match in the comparison an error signal results. The error signal is transmitted by way of cable 5 to the motor 51 of damper D4 for the motor to drive the damper blade 52 to close or open passageway 53 of the damper until the error is nulled.

After the return air passes over the evaporator cooling coil 32 and is dehumidified during the cooling mode of operation, the air enters a space 44 which has a "cool air" exhaust damper D2 comprised of a motor 49 that responds to appropriate signals by operating a damper blade 50 to open or close port 48 as conditions require. When the system is operating in the air heating mode, cool air exhaust damper D2 is at least partially open and warm air damper D1 is fully closed. When operating in the air cooling mode, warm air damper D1 is at least partially open and cool air exhaust damper D2 is closed as will be elaborated shortly hereinafter.

When operating in either mode it is necessary to make up the quantity of cool or warm air that is exhausted by introducing fresh outdoor makeup air into the airstream. Fresh air is admitted to the airstream as it passes through space 44 after the major fraction of the return air has passed over cooling coil 32 and before it has passed over reheat condenser coil 46. The fresh air is drawn through a port 55 under the control of a third damper D3 which is comprised of a damper blade 56 whose position is controlled by a motor 57. Damper D3 is open by some amount whenever the system is in the heating or cooling mode. However, when the pool room is unoccupied as it is overnight, the system is switched to the "unoccupied" mode wherein all of the dampers D1, D2, and D3 are closed.

The system includes a refrigerant compressor 60 having a refrigerant discharge line 61 which connects to the input of a diverter valve 62 that has selectively usable branch output lines 63 and 64. During warm weather when it is necessary to cool the return air from the pool it would be inappropriate to reheat the air after it has been dehumidified and cooled by the cooling coil 32. But, a lot of heat energy has been transferred to the refrigerant vapor in the cooling and dehumidifying coil 32 when warm and humid return air passes over it. This heat is used to restore to the pool water the heat that is lost as a result of the continuous evaporation of pool water. To accomplish the heat transfer, diverter valves DV1 and DV2 are automatically switched by operators 57 and 58 to close off discharge line 64 and open line 63 so hot refrigerant gas can flow from compressor 60 through the coil 65 of the pool water heater where the gas gives up heat and begins to condense to a liquid. The valve switching is done when a pool water temperature sensor, not shown, senses that the pool water is below a specified temperature. This results in the hot refrigerant being conducted to and through the coil 65 which is in pool water conducting chamber 66. The chamber 66 has an infeed pipe for water that is pumped out of the pool and an outlet pipe for returning the water to the pool after it has been heated by passing over coil 65. After passing through water heating coil 65, the refrigerant passes through a one-way valve 69 and then through tube 70 to an expansion valve 71 which vaporizes the liquid refrigerant and thereby cools it in the evaporator coil 32 to make it possible for the unexhausted return air fraction to be cooled and dehumidified. Check valves CV1, CV2, and CV3 prevent liquid refrigerant from backflowing into the two unused condensers instead of the expansion valve 71 and evaporator coil 32.

In extremely hot weather there is not a demand for reheating recirculated pool water with the condenser coil 65 so the heat contained in the refrigerant as a result of absorbing heat from the warm and humid return air by the return air cooling and dehumidifying coil 32 must be disposed of by means of a conventional cooling tower or condenser that is remote from the building.

In the illustrative system an outdoor air cooler 77 is used. It is comprised of a housing 78 containing refrigerant coil 79 over which outdoor air is blown by a motor driven blower, not shown. To permit passing the hot refrigerant gas to coil 79, the refrigerant piping system is provided with a first diverter valve marked 62 and DV1. This valve is switched to close off line 64 and open line 63. And a second diverter valve marked DV2 and 75 is switched by operator 58 to block refrigerant from going into coil 65 and allow it to flow through line 76 to cooling coil 79 in housing 78 wherein the refrigerant begins to condense. After flowing through coil 79, the refrigerant continues through a pipe 81, a valve 80, pipe 70, expansion valve 71 and into cooling coil 32 for being vaporized.

In the cool and cold weather the return air, after having been cooled by passing over evaporator cooling coil 32 for dehumidification, enters space 44 before passing over reheating condenser coil 46. When the system is heating return air, warm air exhaust damper D1 is automatically closed and cold air exhaust damper D2 is automatically opened. Outdoor air intake damper D3 is also open to allow input of cool and usually quite dry makeup air to mix with the air stream. By reason of cool air exhaust damper D2 being open it is possible to get rid of a fraction of air that is the coldest air in the system under the influence of exhaust blower 38. The fraction of return air that is disposed of is coldest and has the least total energy because it has given up heat to the refrigerant vapor in the cooling coil 32. Thus, reheating the quantity of exhausted coldest air is avoided and more heat remains in the refrigerant circuit for reheating the mixture of dehumidified return air and outdoor makeup air. The outdoor air enters the air stream after having passed through protective screen 87, an air filter 88 and damper D3 opening 55.

When the system is operating in the return air reheating mode diverter valve DV1 is switched automatically to close off line 63 and open line 64 so hot compressed refrigerant gas can flow from the compressor 60 by way of line 64 to reheating condenser coil 46, wherein the refrigerant begins to condense, and then through a one-way check valve marked CV1 and 90 and expansion valve 71 to dehumidifying evaporator coil 32 wherein the refrigerant vaporizes, and then back to compressor 60 as gas by way of return pipe 91. Check valve CV3 is closed at this time.

Now that the main components of the return air dehumidifying, cooling and reheating system and the functions of the components have been described, a detailed description of the new control system will be undertaken.

The new control system is notable for maintaining the dehumidifying, cooling and heating system in balance under all ambient conditions. The volume of conditioned supply air must balance, that is substantially equal the volume of return air that is drawn from the pool room.

As indicated earlier, the new control system and method of operating is characterized in part by monitoring the static air pressure drop across three components which are evaporator 32, exhaust blower 38 and reheat condenser 46. Pitot tube PT1 on the inlet side of evaporator and pitot tube PT2 on the outlet side of the evaporator 32 are involved in sensing the static pressure drop across the evaporator. Tubes 10 and 11 respectively connect pitot tubes PT1 and PT2 to a transducer P3. The transducer P3 develops a signal representative of the difference between the two pressures on the inlet and outlet sides of the evaporator and sends an electric signal representing the difference by way of line 100 to programmable controller M1. The controller M1 compares the signal with a stored set point which corresponds to the pressure drop that should occur across coil 32 and if there is a discrepancy, the controller produces an error signal. The error signal is conducted by way of cable 3 to the motor for operating bypass damper D4 to modulate the damper blade 52 to the extent necessary to increase or decrease the air flow volume over evaporator coil 32 and thereby null the error signal. In this way the airflow over the evaporator coil is held constant when the system is operating in the heating or the cooling mode.

Pitot tubes PT4 and PT5 are involved in sensing the static pressure drop across exhaust blower 38. Exhaust blower motor 39 is a single speed motor. Since the volume of return air exhausted by the blower 38 is a function of its rotational speed and the static pressure difference between its inlet and its outlet, the fraction of humid return air that is exhausted is controllable by controlling the inlet static pressure of the blower. This is done by opening the warm air damper D1 when operating in the air cooling mode and opening the cold air damper D3 when operating in the heating mode. The static pressures sensed by pitot tubes PT4 and PT5 are conducted by way of tubes 6 and 7 to transducer P1 which determines the difference between the pressures from PT4 and PT5 and develops an electric signal corresponding to the difference between pressures that is transmitted to controller M1 by way of line 101. The controller compares the difference signal with a set point and produces an error signal if there is a discrepancy. An error signal would be transmitted to correct the lack of comparison with the set point. The response by the controller to the signal representing the pressure drop across the exhaust blower 38 depends on whether the system is operating in the pool room air heating mode or the cooling mode.

Controller M1 is provided with the return air temperature, that is, the pool room temperature and the outdoor temperature. Controller M1 is also provided with a return air humidity signal. These signals are used by the controller M1 to determine if the system should be operating in the heating or cooling mode. If in the cooling mode, the error signal mentioned in the preceding paragraph will modulate damper D1 and if in the heating mode it will modulate damper D2 so the set points are matched by the difference between sensed static pressures.

Pitot tube PT2 senses the static pressure on the inlet side of the reheat condenser 46 and PT3 senses the static pressure on the outlet side of condenser 46. The air volume flowing over coil 46 is the sum of the major fraction of return air that is not exhausted by way of warm air damper D1 or cold air damper D2 and the volume of outside air that is drawn into the airstream through damper D3. The sum of the air volumes comprised of the outdoor air and one of the other major fraction volumes is also exactly equal to the air volume that is supplied to the pool room by supply blower 22.

Tube 8 connects pitot tube PT2 to pressure transducer P2 and tube 9 connects PT3 to the transducer. The difference between the pressures from PT2 and PT3 is determined and the representative signal is conducted by way of line 102 to controller M1 where the signal is compared to a set point to determine if a discrepancy exists. If so, the resulting error signal is transmitted by way of cable 3 to control the motor of damper D3 to modulate outdoor air inflow so the total air supplied to the pool room substantially equals, that is, balances the return air drawn out of the room.

Cooling and heating operating modes will be described next. The heating mode will be discussed first. The system goes into the heating mode in response to occurrence of the pool room air dropping below a set point. Programmable controller M1 will cause warm air exhaust damper D1 to close. Bypass damper D4 will be adjusted in response to the static pressure drop across evaporator coil deviating from set point. Refrigeration compressor Cl runs in response to the call for heat in the pool room. Diverter valve DV1 closes off tubular line 63 and permits flow of high pressure hot refrigerant gas from the compressor through line 61, DV1, line 64, reheat condenser coil 46 wherein condensation of the gas occurs, and then through check valve CV1, while check valves CV2 and CV3 are closed to prevent back flow to coils 65 and 79. With CV1 open, refrigerant flows through tubular line 70 and expansion valve 71 into evaporator coil 32 where the refrigerant vaporizes for cooling and dehumidifying the return air.

A fraction of the cool return air drawn through coil 32 is exhausted through open damper D2 and exhaust blower 38 since this fraction is taken from the coldest air in the system during the heating mode. The low pressure vaporized refrigerant in evaporator coil 32 is conducted back to compressor C1 by way of tube 91. The compressor C1 compresses the refrigerant, thereby adding heat energy to it. The hot refrigerant gas then flows by way of tube 64 into the reheat condenser coil 46 wherein condensation of the gas occurs and then through valve CV1 to evaporator valve 71 again. The major fraction of the return air that is not exhausted plus the outdoor air that makes up for the exhausted cold air is heated as it passes over the reheat condenser coil 46 and is supplied to the pool room by supply blower 22.

After extended operation the system may get out of balance due to poor maintenance such as allowing the return air filter 30 to get too dirty and partially blocked, the resulting decrease in air flow over dehumidifier evaporator coil is sensed as previously explained and the controller M1 would cause bypass damper D4 to close by an amount sufficient to cause more air to flow over evaporator coil 32 to restore this airflow to set point. The new control system, according to the invention, would function similarly to compensate for restricted inflow of makeup air by controller M1 effecting a greater opening of damper D3 until the inflow matches the set point. Of course, if for some reason airflow increases above set point through any part of system, the appropriate damper will be modulated in the correct direction to restore flow to match the set point.

When the pool room temperature rises above a set point, the controller M1 responds by switching the system to the cooling mode of operation. Return air humidity tends to be higher when the pool room is warm. In the cooling mode of operation, warm air damper D1 opens and cold air damper D2 closes. Return air volume flowing over evaporator coil 32 is held constant in the cooling mode of operation as it is during the heating mode by modulating bypass damper D4 in response to the static pressure differences sensed by PT1 and PT2. An error signal from controller M1, representing any deviation from the set point for flow through evaporator coil 32 causes the opening of damper D4 to change. As was mentioned earlier, during the cooling mode of operation it is desirable to exhaust a fraction of the warm and humid return air that contains the most sensible and latent heat so the fraction does not have to be subjected to cooling and so there is space available in the airstream for fresh outdoor makeup air to be added.

The size of the fraction of warm return air that is exhausted through damper D1 depends on the difference in static pressures sensed by pitot tubes PT4 and PT5 as the drop across exhaust blower 38. If the difference does not meet the set point for maintaining a constant volume flow of an exhaust air fraction, controller M1 develops and sends out over cable 2 an error signal for adjusting damper D1 to restore the exhausted return air to set point and null the error signal.

In the cooling mode of operation the percentage or cubic feet per minute of air that is exhausted must be made up with fresh outdoor air drawn in through D3. The amount of outside air desired is governed by the difference in static pressures between the inlet and outlet of reheat condenser. This difference in pressures is also indicative of the cubic feet per minute of air supplied to the pool room by exhaust supply blower 22 to fulfill the requirement of the building code for a specified number of total room air changes per hour. The static pressures are sensed by pitot tubes PT2 and PT3. The difference in pressures is determined in transducer P2 and is compared with a set point by controller M1. If there is no match the controller issues an error signal which is transmitted over cable 3 to modulate damper D3 until the error signal is nulled in which case the volume of outdoor air drawn in is maintained constant as specified.

All of the pitot tubes are sensing static pressures at all times during operation of the system and are periodically adjusting the dampers in response to variations in pressure differences that may occur and result in an error signal being produced.

When the system is operating in the cooling mode the reheat condenser 46 is not in use. Heat absorbed from the warm and humid return air may then be used for heating pool water to make up for heat lost due to evaporation. If there is more heat available than is required for supplementary pool water heating then the balance of the heat energy may be dissipated to the atmosphere using air cooled heat exchanger 77. When using air cooled heat exchanger 77, refrigerant is conducted through coil 79 and diverter valve DV2 is set automatically to permit refrigerant flow through tube 76, coil 79, tube 81 and valve CV3 while valve 71 is closed and then through tube 70.

When there is pool water heating, diverter valve DV1 is closed to shut off tube 64 to the condenser and allow hot refrigerant gas to flow through pipe 63, valve DV2, coil 65 wherein condensation of the gas starts, valve 69, and tube 70 to expansion valve 71 to cool incoming return air. Pool water is fed into heat exchanger 66 by way of pipe 67 and is returned to the pool by way of pipe 81.

What is claimed is:

1. Improved control apparatus for balancing and controlling an air conditioning system operative in an air cooling mode or an air heating mode to cool or heat ambient air in a swimming pool room, the conditioning system comprising:

a main duct having an inlet for return air drawn from a pool room, a supply air blower positioned downstream in the duct from said return air inlet said blower having an inlet for drawing an airstream through the duct and an outlet for supplying conditioned air to said pool room, a return air cooling evaporator coil having a return air inlet side and an air outlet side, and an air reheating condenser coil having an air inlet side and an outlet side, said evaporator and condenser coils being arranged in said duct in the stated order between the inlet to the duct for return air and the supply air blower, each coil having an inlet and an outlet for refrigerant, a refrigerant compressor having an outlet for compressed refrigerant and an inlet for returned refrigerant, an exhaust blower having an inlet and an outlet from which air is exhausted to the outdoor atmosphere, a warm air damper and a motor for controlling the damper, the warm air damper being interposed between the return air inlet side of said evaporator coiled and said exhaust blower inlet, a cool air damper and a motor for controlling the damper, the cool air damper being interposed between said air outlet side of the evaporator and said exhaust blower inlet, a makeup air damper and a motor for controlling the damper the makeup air damper being interposed between said outlet side of the return air cooling condenser and the outdoor atmosphere, said makeup damper is controlled to effect drawing in outdoor air in sufficient volume to make up for the fraction of the return air volume that is exhausted by way of said warm air damper when the air conditioning system is operating in the pool room air cooling mode while the cool air damper is closed and to make up for the fraction of return air volume that is exhausted by way of said cool air damper when the system is operating in the pool room air heating mode while the war air damper is closed, a bypass damper and a motor for controlling the damper, the bypass damper is arranged to bypass a percentage of the volume of return air past the evaporated coil, said control apparatus comprising: a controller for controlling the damper motors, a first pair of static air pressure sensors, one positioned at the return air inlet side and the other positioned downstream at the air outlet side of the evaporated coil to provide for determining the static pressure drop across said evaporator coil and volume of air flowing over the evaporator coil, a second pair of static air pressure sensors, one positioned at the air inlet side and the other positioned at the air outlet side of said exhaust blower to provide for determining the static pressure drop across the exhaust blower and the volume of the return air exhausted by the open one of the warm air or cool air exhaust dampers, a third pair of static air pressure sensors, one positioned at the air inlet side of said reheat condenser coil and the other positioned on the outlet side to provide for determining the static pressure drop across the reheater coil and the total volume of air drawn through said main duct by said supply air blower, transducer means operative to determine the differences between the pressures sensed by sensors in the respective pairs of sensors and to produce signals respectively corresponding to the pressure differences, said controller is operative to compare said pressure difference signals, respectively, with predetermined set points and if a variance exists between a pressure difference signal and its set point said controller produces a control signal for controlling the motor of the damper to which the variance relates to adjust said damper until said variance is nulled.

2. The control system according to claim 1 wherein said sensors comprising said pairs of sensors are pitot tubes, tubing connects the pitot tubes in the same pairs to individual transducers, respectively, and said transducers output said signals that correspond to pressure differences to said controller.

3. A control system for a swimming pool room air conditioning system that comprises:

a main duct having a return air inlet into which return air is drawn from the room and having a supply blower downstream of the inlet, the supply blower having an inlet disposed for drawing an air stream through the duct and having an outlet for supplying a number of cubic feet per minute of conditioned air to the room that substantially balances the cubic feet per minute of return air drawn from the room, a refrigerant evaporating coil for cooling and dehumidifying air and a reheat refrigerant condenser coil arranged in succession in the stated order in said main duct between said return air inlet and said inlet of the supply blower, said evaporating coil having an inlet side for return air and having an air outlet side, and said condenser coil having an inlet side downstream of said outlet side of the evaporator coil and having an outlet side upstream of said inlet of said supply air blower, a bypass damper and a motor for regulating the damper to control the cubic feet per minute of return air that bypasses the evaporator coil and thereby controls the cubic feet per minute of air that passes over the evaporator coil, and a refrigerant compressor, said control system comprising: a controller for controlling the motor of the bypass damper to regulate the damper for maintaining a predetermined cubic feet per minute of return air to flowing over said evaporator coil, devices for continuously determining the static pressure difference between said return air inlet side and the outlet side of said evaporator coil, said devices including a pitot sensor positioned for sensing the static pressure at the return air inlet side of the evaporator coil and a pitot tube at the outlet side of the evaporator coil, a transducer having input means for the static pressures sensed by the pitot sensors and output means for a difference signal corresponding to the difference between the static pressures, and said controller is operative to compare said difference signal with a set point and if there is a variance between the difference signal and set point to produce a signal for causing said motor to regulate the damper until the difference between the static pressure at the inlet and outlet sides of the evaporator coil results in nullifying said variance.

4. Apparatus according to claim 3 including a second damper that provides for said supply blower drawing in air from outside of the building that contains the swimming pool room, said second damper including a motor for regulating the damper, said damper arranged for controlling the cubic feet per minute of outdoor air flowing from outside of the building into the airstream that flows into said inlet side of said condenser coil and from the outlet side of the condenser to the inlet of the supply blower, said control system also including a pitot sensor positioned for sensing the static pressure at the air inlet side of the reheat condenser coil and a pitot sensor positioned for sensing the static pressure at said air outlet side of the condenser coil to provide for balancing the total cubic feet per minute of air drawn from the swimming pool room with the sum of the cubic feet of air per minute that bypasses the evaporator coil that passes over the evaporator coil and the outdoor air drawn into the airstream, a second transducer having input means for the static pressures sensed by said pitot sensors and output means for a second difference signal corresponding to the difference between said static pressures, and said controller is operative to compare said difference signal with a set point and if there is a variance between said second difference signal and set point to produce a signal for causing said motor to regulate said second damper until the difference between the static pressure at the inlet and outlet sides of said condenser coil results in nullifying said variance.

5. Apparatus according to claim 3 including:

an exhaust blower having an air inlet side and an air outlet side for exhausting air to the outside of a building that contains said swimming pool room, a warm air damper including a motor for regulating the damper and said damper is arranged for said exhaust blower to draw a predetermined fraction of the cubic feet per minute of return air drawn from the pool room when the conditioner is in the air cooling mode and exhaust said fraction to the outside of the building containing the swimming pool room such that the remainder of the return air will be drawn through said bypass damper and over said evaporator coil, said control system including a pitot sensor positioned at the return air inlet side of said exhaust blower and a pitot sensor positioned at the air outlet side of the exhaust blower for sensing the static air pressure at said air inlet and outlet sides to provide for maintaining said predetermined fraction of exhaust return air constant, a third transducer having input means for the static pressures sensed by said pitot sensor and having output means for a third difference signal corresponding to the difference in static pressures across said exhaust blower, and said controller is operative to compare said third difference signal with a set point and if there is a variance between said signal and the set point to produce a signal for causing the motor for said warm air damper to regulate the damper until the difference pressure between said inlet and outlet sides of said exhaust blower results in nullifying said variance.

6. Apparatus according to claim 5 including:

a cool air damper including a motor for regulating the damper and said damper is arranged for said exhaust blower to draw a predetermined fraction of the total cubic feet per minute of return air that flows over and bypasses said evaporator coil when said warm air damper is closed and said conditioner is in the air heating mode and exhaust said fraction to the outside of the building containing said swimming pool room such that the remainder of the return air will be drawn over said air reheat condenser coil and to said supply blower inlet, said controller is operative when said conditioner is operating in the air heating mode to compare the third difference signal to a set point corresponding to the predetermined cubic feet of air per minute that is designated to be exhausted through the cool air damper and if there is a variance between said signal and set point to produce a signal for causing the motor for the cool air damper to regulate the damper until the difference pressure between said inlet and outlet of said exhaust blower results in nullifying said variance.

* * * * *

UNITED STATES PATENT AND TRADEMARK OFFICE

CERTIFICATE OF CORRECTION

PATENT NO. : 5,682,754

DATED : November 4, 1997

INVENTOR(S) : Peter E. Groenewold

It is certified that error appears in the above-identified patent and that said Letters Patent is hereby corrected as shown below:

Column 10, Line 61 Delete "war" and substitute --- warm ---

Signed and Sealed this

Twenty-fourth Day of March, 1998

*Attest:*

BRUCE LEHMAN

*Attesting Officer*

*Commissioner of Patents and Trademarks*